United States Patent [19]

Seybold

[11] 4,057,374

[45] Nov. 8, 1977

[54] ROTARY INTERNAL COMBUSTION ENGINE WITH UNIFORMLY ROTATING PISTONS COOPERATING WITH REACTION ELEMENTS HAVING A VARYING SPEED OF ROTATION AND OSCILLATING MOTION

[76] Inventor: Frederick W. Seybold, 1979 Dogwood Drive, Scotch Plains, N.J. 07076

[21] Appl. No.: 719,998

[22] Filed: Sept. 2, 1976

[51] Int. Cl.[2] ..... F01C 1/00

[52] U.S. Cl. ..... 418/36; 123/8.47

[58] Field of Search ..... 123/8.47; 418/34, 36

[56] References Cited

U.S. PATENT DOCUMENTS

| | | | |
|---|---|---|---|
| 3,061,180 | 10/1962 | Durgin | 418/36 |

FOREIGN PATENT DOCUMENTS

| | | | |
|---|---|---|---|
| 1,122,549 | 1/1962 | Germany | 418/36 |
| 1,098,520 | 2/1961 | Germany | 418/36 |

*Primary Examiner*—Carlton R. Croyle
*Assistant Examiner*—Michael Koczo, Jr.

[57] ABSTRACT

A rotary internal combustion engine comprising a stationary, water cooled housing having a large cylindrical bore in which a hollow cylinder with end walls rotates at a uniform speed. On said cylinder a pair of wedge-shaped pistons is mounted diametrically opposed to a similar pair of reactor elements carried by a multiple-splined shaft, said reactor elements and said pistons forming a combustion chamber whereby a gas and air mixture is compressed prior to ignition, whereupon said reactor element moves several degrees oppositely to the uniformly rotating piston while expansion is taking place.

This short reverse rotation of the reactor element is derived from a gear mechanism which provides a short period of reverse rotation and a longer period of rotation in the same direction as the piston, but at a higher speed, whereby the burned gases will be exhausted as the reactor element approaches its mating piston and/or compresses the intake mixture of gas and air between the other pair of piston and reactor element before a second ignition takes place during one revolution of the cylinder.

8 Claims, 10 Drawing Figures

FIG. 1
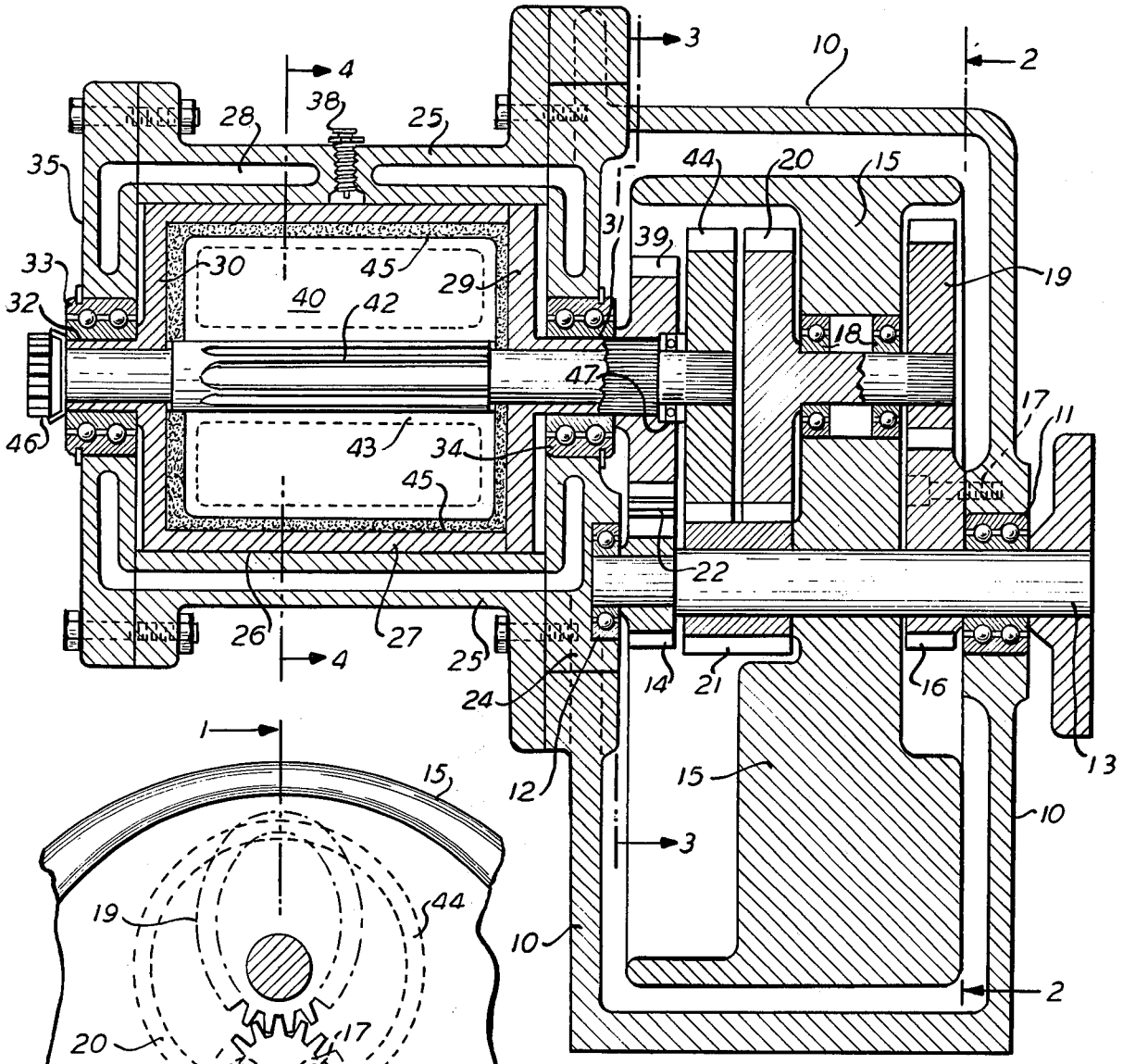
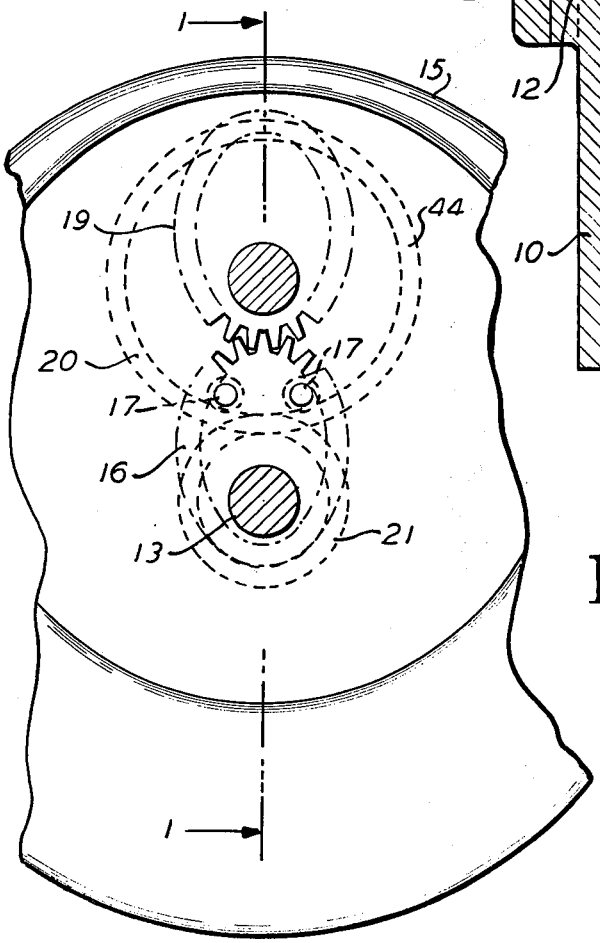
FIG. 2

FIG. 3
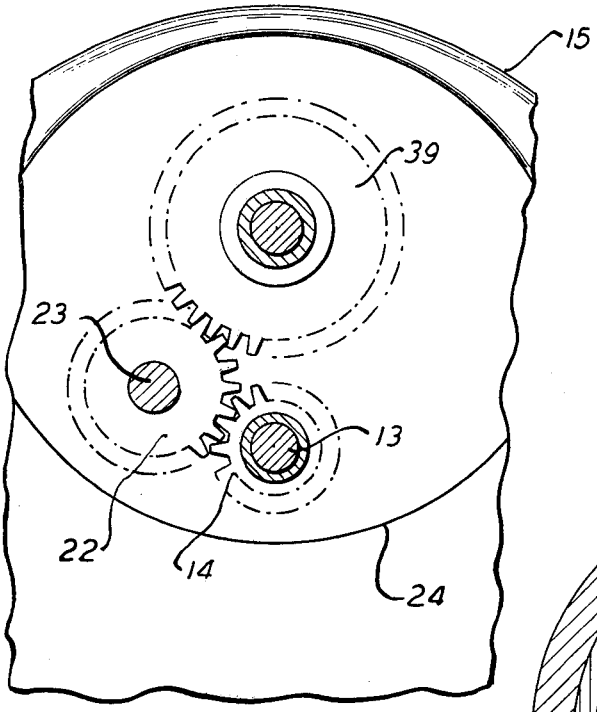
FIG. 4
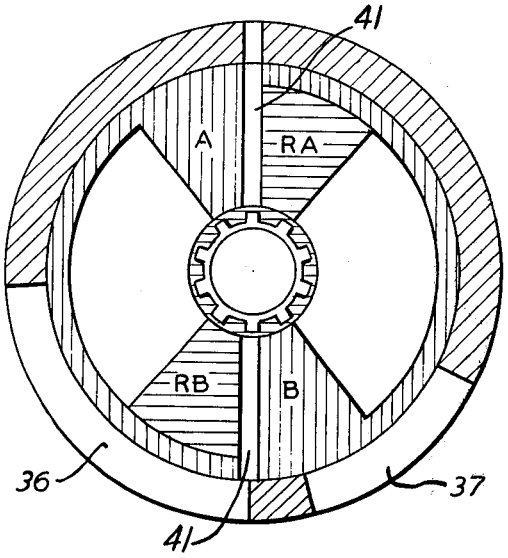
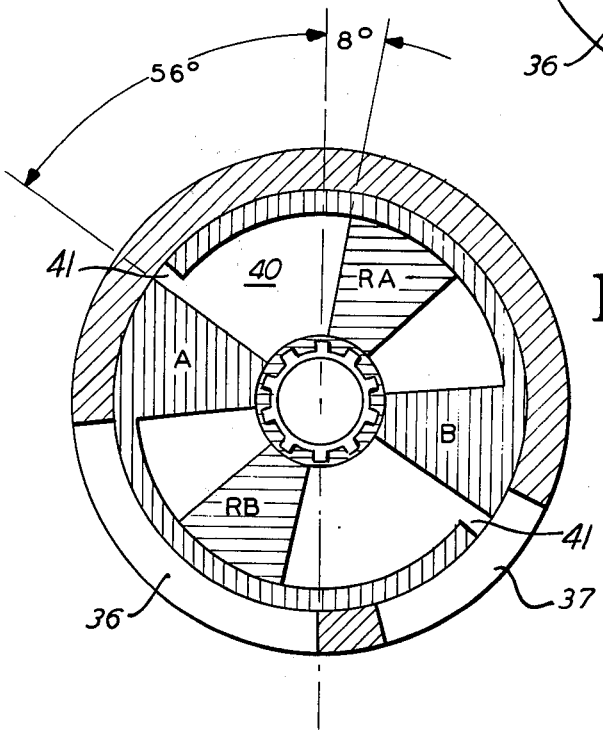
FIG. 9

FIG. 5
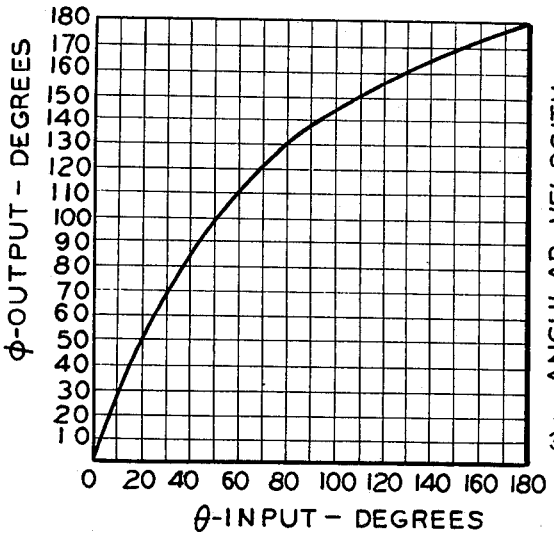
FIG. 6
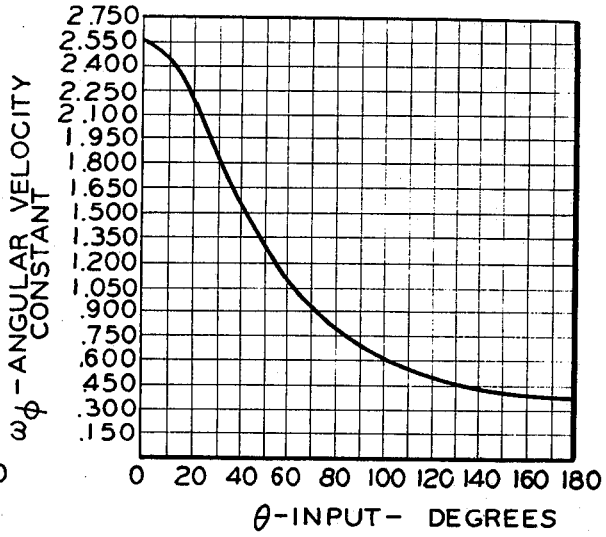
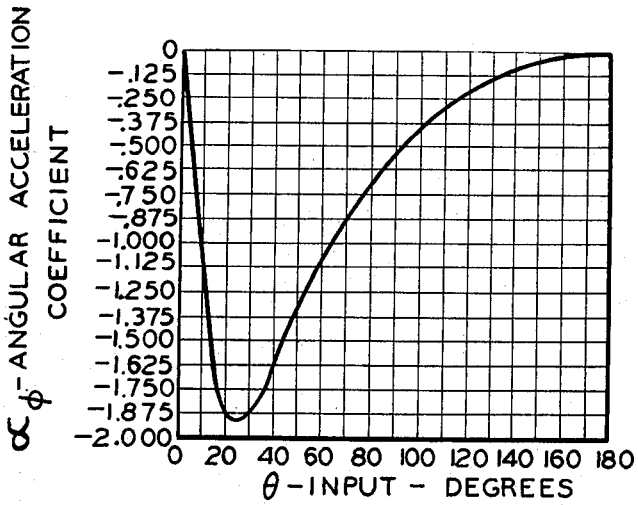
FIG. 7
FIG. 8
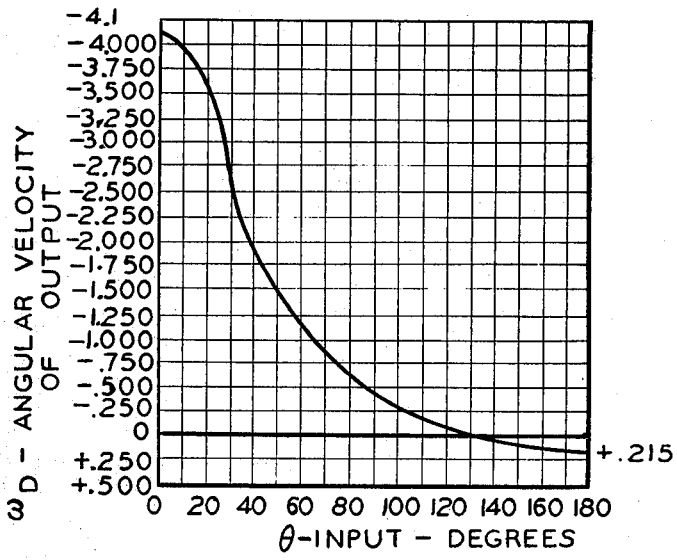

ROTARY INTERNAL COMBUSTION ENGINE WITH UNIFORMLY ROTATING PISTONS COOPERATING WITH REACTION ELEMENTS HAVING A VARYING SPEED OF ROTATION AND OSCILLATING MOTION

Many rotary internal combustion engines have been invented and most of them have not been very sucessful with the exception of the recent "Wankel" engine. However this engine has a difficult problem of effectively sealing of the rotor and the machining of the rotor housing at present requires special machine tools. The exposure of gearing to high heat is another objectionable feature of this engine.

It is, therefore, a primary object of this invention to provide a rotary engine that is composed of simple parts which can be manufactured on standard machine tools at low cost.

A further object of this invention is the elimination of the multi-throw crankshaft of the conventional piston engine.

A still further object is to discard the expensive valve mechanism composed of gears, cams and springs.

It is also an object of this invention to provide an engine which has a constant torque arm compared to the variable torque arm of a crankshaft.

An additional object of this invention is to provide a rotor which can be effectively sealed against compression loss.

A final and most important object of this invention is the conversion of the counter torque imposed on the reactor at ignition and expansion by means of gearing to the flywheel, said gearing not being exposed to a high heat.

FIG. 1 is a transverse section of the two-piston rotor engine, taken along line 1 — 1 of FIG. 2;

FIG. 2 is a section taken along line 2 — 2 of FIG. 1;

FIG. 3 is a similar section taken along line 3 — 3 of FIG. 1;

FIG. 4 is a cross-section taken along line 4 —4 of FIG. 1;

FIG. 5 shows the relation between degrees of flywheel rotation and the corresponding motion of the planet elliptic gear;

FIG. 6 shows the angular velocity constant of the planet elliptic gear corresponding to a position of the flywheel;

FIG. 7 shows the angular acceleration coefficient of the planet elliptic gear corresponding to a position of the flywheel;

FIG. 8 shows the angular velocity of the output member of the reverted gear train receiving power from the reactor of the rotary engine;

FIG. 9 shows the reactor element having moved oppositely to the piston;

Figure 10:
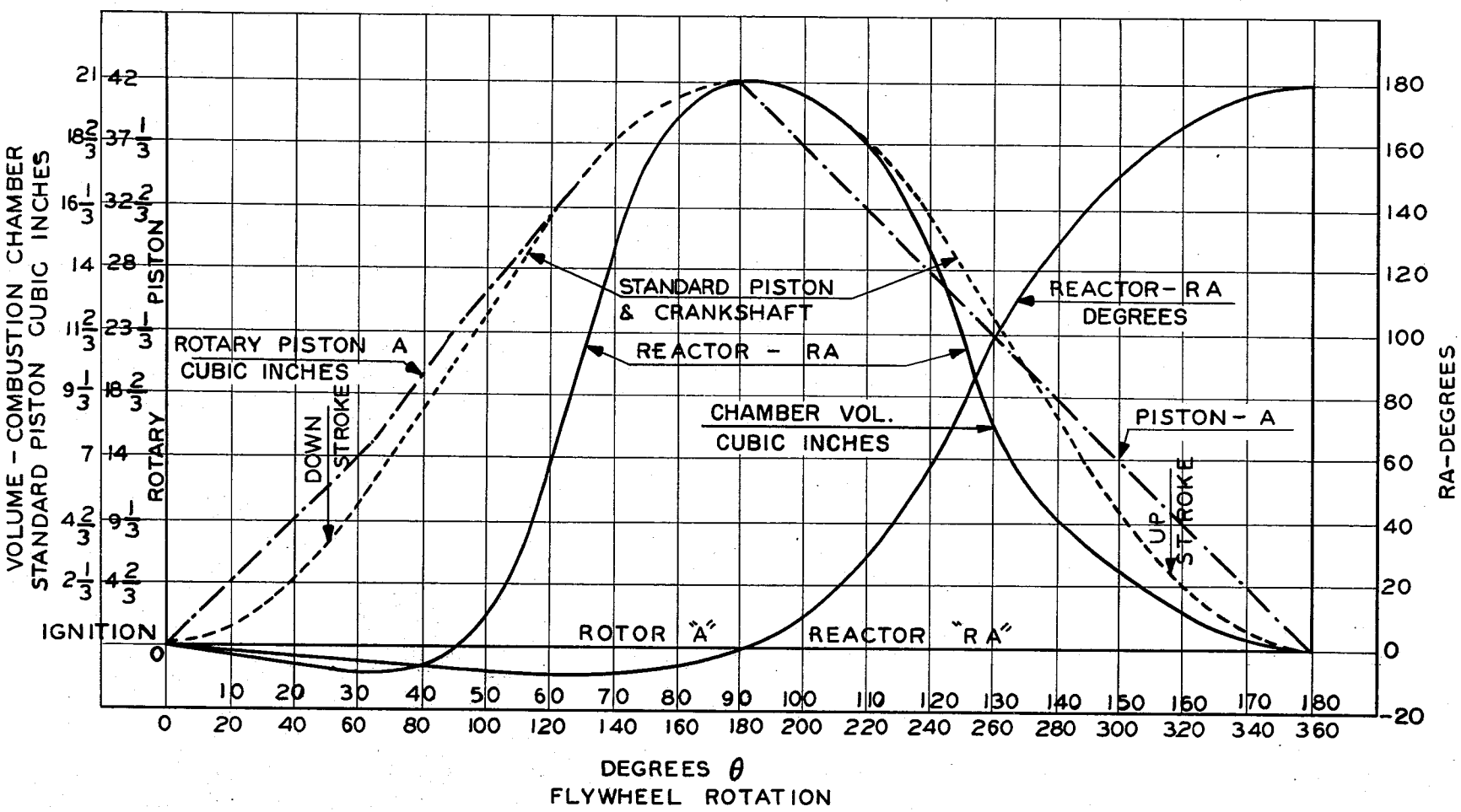

FIG. 10 compares the combustion chamber volume of a standard piston-crankshaft engine to that of the new rotary engine and also shows the reactor positions at different degrees of flywheel rotation.

GENERAL ARRANGEMENT

The structural elements comprising the rotary engine consist of a water-cooled housing having a large cylindrical bore in which a hollow rotor with axially spaced side walls is free to rotate and on which two wedge-shaped, diametrically opposed pistons are mounted.

These side walls have long hubs carrying ball bearings held in the housing.

The pistons cooperate with similarly shaped reaction members enclosed in this cylindrical rotor and they are mounted on a multiple-splined shaft, both ends being journalled in the long hubs of said rotor. One of said shaft ends has serrations on which a large spur gear is mounted, while the other end of said shaft is threaded to receive a lock nut.

The water-cooled housing is bolted to a larger housing in which a drive shaft is journalled on ball bearings supported in the housing. A large flywheel and a small pinion are secured to this drive shaft and this pinion meshes with an idler gear which is free to turn on a stud secured in the housing. This idler gear meshes with a spur gear which is secured on one of the long hubs of said rotor, said spur gear being twice the size of the pinion on the drive shaft, whereby a drive between the rotor and the flywheel is established.

An elliptic gear is fastened to the large housing and it mates with another elliptic gear which is compounded with a spur gear and they are mounted on ball bearings carried by the flywheel, said spur gears being the same size as the gear mounted on the serrated and of the multiple-splined shaft. A pinion one-half the size of said two spur gears is free to turn on the drive shaft and it mates with both said spur gears, whereby a drive from the reaction elements to the flywheel is established, said flywheel rotating twice as fast as the rotor of the engine.

Suitable exhaust and intake porting is provided in the stationary housing at the proper location. Longitudinal, helical slots in the rotor serve as passages to and from the rotor to the porting, and these slots are described and illustrated in my U.S. Pat. No. 3,955,541.

One or more spark plugs projecting thru the housing will ignite the air mixture when these slots become aligned with the spark plug.

DESCRIPTION OF THE INTERNAL COMBUSTION ENGINE

The components of the engine may be divided into four assemblies:

1. The flywheel housing and the water-cooled rotor compartment.
2. The rotor assembly with its associated gearing which drives the flywheel.
3. The reactor assembly
4. The stationary reaction gear.

1. The flywheel housing 10 is provided with ball bearings 11 and 12 on which the drive shaft 13 is journalled. A pinion 14 secured to this shaft as well as the large flywheel 15. Elliptic gear 16 is fastened to the flywheel housing by means of the screws 17. Spaced ball bearing 18 are fitted into the bore of the flywheel 15 and they support the planet compound gears 19 and 20. Gear 19 also has an elliptic shape and meshes with the stationary elliptic gear 16. The gear 20 meshes with the wide pinion 21 which is free to turn on the drive shaft 13, gear 19 is secured on the serrated stem of the gear 20, which is journalled on the bearings 18.

2. The rotor compartment 25 is bolted to the flywheel housing 10 and this compartment has a cylindrical bore 26 into which the rotor 27 is closely fitted for rotation therein. The compartment 25 is provided with cavities 28 for the reception of cooling water. The rotor 27 has side walls 29 and 30 from which project hubs 31 and 32 respectively, and they are journalled on snap-ring ball bearings 33 and 34, respectively supported on the rotor compartment 25 and the end cover 35 which is bolted to the rotor compartment 25. The rotor compartment is also provided with an exhaust port 36 and an intake port 37. A spark plug 38 is centrally located at the top of the rotor compartment 25. An idler gear 22 is free to turn on a stud 23 which is held in the side wall 24 of the rotor compartment 25. On hub 31 a gear 39 is secured which meshes with the idler gear 22, whereby a drive from the rotor 27 to the flywheel 15 is established. Between the walls 29 and 30 two diametrically opposed, wedge-shaped pistons A and B are secured to the rotor 27, and adjacent thereto longitudinal slots 41 have a helical shape as described in my U.S. Pat. No. 3,955,514.

3. The reactor assembly comprises a long, multiple-splined shaft 42 which is journalled in the hubs 31 and 32. A long hub 43 is fitted on the splined shaft 42 and the wedge-shaped reactors RA and RB are integral with the hub 43, and with the pistons A and B respectively a combustion chamber 40 is formed. The back faces of reactors RA and RB are hollowed out to reduce their weight and their sides and top have grooves for the reception of the seals 45. A spur gear 44 is fast on the serrated end of the multiple-splined shaft 42 and it meshes with the wide face pinion 21. A thrust bearing 47 is interposed between gear 44 and 39. An adjusting nut and washer 46 is in contact with the hub 32 and the ball bearing 33, whereby the rotor 27 and the reactors RA and RB are held in their correct location and still permitting longitudinal expansion due to heating and allowing lateral movement of gear 44.

4. The stationary elliptic reaction gear 16 is secured to the side wall 46 of the flywheel housing 10 by means of the screws 17, and it mates with the elliptic gear 19. An elliptic gear pair produces a varying angular rotation of the driven gear when the driving gear has a uniform angular rotation. The maximum angular speed of the driven gear is greater than the uniform driving gear speed, it must be no less the 2½ times the driving gear speed, and the minimum angular speed, which is the reciprocal of its maximum speed, will cause a reversal of rotation of the wide faced pinion 21, and since said pinion 21 must make one net revolution of 360° per cycle it will have rotated more than 360° during one cycle.

OPERATION OF THE ENGINE

An elliptic gear pair produces a varying angular rotation of the driven gear when the driving gear has a uniform angular rotation. The maximum angular speed of the driven gear is greater than the speed of the driving gear and its minimum angular speed is the reciprocal of its maximum speed and it is always less than the constant driving speed.

The variable speed ratios of the wide-faced pinion 21 corresponding to one revolution of the uniformly rotating flywheel 15 are determined by the well-known step method for planetary gearing, wherein one member remains stationary. Assume that the flywheel 15, the elliptic gears 16 and 19 are locked together and in this condition they are made to turn (+ 1) revolution, as shown on the first line below.

Next on the second line the gearing is now assumed to be in its normal, unlocked condition, the flywheel 15 is held stationary (O), and then the elliptic gear 16 is turned in the opposite (− 1) direction, thereby returning gear 16 to its normal stationary condition, and then observe the amount and direction of rotation of the compound gearing comprising the elliptic gears 16 and 19 and the compound spur gears 20 and 21.

Then on the third line are recorded the sum of lines 1 and 2, and it also shows the variable angular velocity in amount and direction of the wide-faced pinion 21 for one (+ 1) revolution of the flywheel 15, the ratio of Gear 20/Gear 21 being equal to 2.

| | Flywheel 15 | Elliptic Gear 16 | Wide-faced pinion 21 |
|---|---|---|---|
| | 1 | 1 | 1 |
| Hold | 0 | −1 | $-\frac{\text{Gear 16} \times \text{Gear 20}}{\text{Gear 19} \times \text{Gear 21}}$ |
| | 1 | 0 | $1-\frac{\text{Gear 16}}{\text{Gear 19}} \times 2$ |
| Maximum speed | of Wide-faced Pinion 21 | | 1−(2.55 × 2)=−4.1 |
| Mean speed | " | | 1−(1 × 2) = −1 |
| Minimum speed | " | | 1−(.392 × 2)=215 |

FIG. 6 shows the velocity ratio of the elliptic gears, their maximum ratio being 2.55 : 1, their mean ratio being unity, and their minimum ratio being 0.393.

FIG. 8 shows the angular velocity of the wide-faced pinion 21, its maximum angular velocity is 4.1 times that of the flywheel and it turns oppositely, the pinion 21 will reverse when the angular velocity ratio between the elliptic gears is ½ and it occurs when the flywheel has turned 119° 26′.

As the rotor speed is ½ that of the flywheel the rotor with piston will have turned approximately 60° before the reactor element begins to turn slowly in the same direction as the piston. Expansion is still proceeding until the piston uncovers the exhaust port and the explusion of the burned gas will take place at a rapid rate.

Since there are two sector-shaped combustion chambers in the rotor there will occur two power pulses during one revolution of the rotor and two revolutions of the flywheel, it follows, therefore, that an engine constructed according the above description is equivalent to a four cylinder piston engine, or a "Wankel" engine with two rotors.

The expansion pressure on the piston and the reaction elements is at all times the same as the amount of power delivered by each varies directly with their speed of rotation, therefore, at the flywheel position 0 equal to 180°,there the reaction element delivers 0.215 times or 21.5% of the amount of power delivered by the piston.

For comparison assume the following specifications for a standard 4 cycle crankshaft engine:

Bore 3 inches — Piston Area A = 7 in.$^2$
Stroke L = 3 in. = .25 ft.
Revolutions per min. N = 3600
Intakes per revolution = 2
Mean effective pressure P = 100 lb. per in.$^2$ $$HP = \frac{2 \times P \times L \times A \times N}{33000} = \frac{2 \times 100 \times .25 \times 7 \times 3600}{33000} = 38.2$$

Volume of gas per stroke — 3 × 7 = 21 in.$^3$
Volume of gas per min. — 2 × 21 × 3600 = 151,200 in.$^3$ per min.

For comparison assume the following specifications for the rotary internal combustion engine described in this invention:

Rotor bore 26 = 7 in. in dia. Multiple-splined shaft 47 = 1 in. dia.
Chamber area 1/4 of .7854 ($7^2 - 1^2$) = 37.7 / 4 = 9.35 in.$^2$
Rotor length 4.5 in. Volume of one chamber = 9.35 × 4.5 = 42 in.$^3$
Piston Area A = 3 × 4.5 = 13.5 in.$^2$
Mean effective pressure P = 100 lb. per in. acting on the above -continued area at a 2.1 in. radius or .175 ft. on an 90 degree arc or $\pi/2$ radius L = .276 ft.

Revolutions per min. M = 1800

Intakes per revolution = 2

$$HP = \frac{2 \times P \times L \times A \times N}{33000} = \frac{2 \times 100 \times .276 \times 13.5 \times 1800}{33000} = 40.5$$

In the above computation no account was been taken of the power which is transmitted by the reaction element to the flywheel.

Volume of gas per min. = 2 × 42 × 1800 = 151,200 in.$^3$ per min.

I claim:

1. A rotary internal combustion engine comprising in combination:

a. a first housing having a circular bore, exhaust and intake ports, water cooling cavities and ignition means, b. two side frames supporting said housing, c. a hollow cylindrical rotor rotatable in said circular bore, two diametrically opposed wedge-shaped pistons integral with said rotor, and axial, helical slots adjacent to said pistons, d. side walls on said rotor with first and second hubs thereon for mounting snap-ring bearings held in said side frames, said first hub being serrated e. a first spur gear mounted on said serrated hub, f. a multiple-splined shaft journalled in said first and second hubs, one end of said shaft being threaded to receive adjustable locking means, the other, longer serrated end of said shaft mounting a second spur gear, g. a reactor element having two diametrically opposed, wedge-shaped means integral with a long hub, said hub being splined and mounted on said multiple-splined shaft, and grooves in said reactor elements to receive seals, h. a second and larger housing, said first housing and side frames being bolted thereto, i. a drive shaft supported on a first ball bearing held on one side frame and a second ball bearing supported on said second housing, j. a large flywheel and a pinion being secured on said drive shaft, k. a stud secured in one side frame on which an idler gear is rotatably mounted, said idler gear meshing with the pinion on said drive shaft and said first spur gear, l. a compound gear mounted on ball bearings supported on said flywheel, said compound gear comprising a third spur gear and a first elliptic gear, m. a second elliptic gear secured to said second housing and mating with said first elliptic gear, n. a second wide-faced pinion free to turn on said drive shaft and mating with said second and third spur gears, o. whereby, after ignition, the expanding gas causes the reactor element at first to turn in a direction opposite to that of the piston and to exert a useful driving force on the piston as well as on the reactor element.

2. A rotary internal combustion engine comprising in combination the elements set forth in claim 1, whereby said wide-faced pinion will turn said second spur gear on said multiple-splined shaft and the reactor element will receive, after ignition, a varying angular motion comprising a small reverse motion to be followed by a greater forward motion in excess of 180°, said angular reverse motion being equal to said excess.

3. A rotary internal combustion engine comprising in combination the elements set forth in claim 1, in which the velocity ratio between said first and second elliptic gears is at least 2½ times flywheel speed.

4. A rotary internal combustion engine comprising in combination the elements set forth in claim 1, in which the maximum speed ratio between the elliptic gear pair must be greater than the speed ratio between said wide-faced pinion and said third spur gear.

5. A rotary internal combustion engine comprising in combination the elements set forth in claim 1, in which the pinion on the drive shaft is one-half the size of said first spur gear on said rotor, whereby said flywheel makes two revolutions per cycle to one of said cylindrical rotor.

6. A rotary internal combustion engine comprising in combination the elements set forth in claim 1, in which the wide-faced pinion being one-half the size of said second spur gear on the reactor element, and the pinion on said drive shaft being also one-half the size of said first spur gear, whereby two revolutions of the flywheel will turn said rotor 360° uniformly and the reactor will produce two variable forward and reverse motions of net 180°, and at each point of reversal an ignition occurs, resulting in two power pulses on said rotor.

7. A rotary internal combustion engine comprising in combination, two stationary housings to support a hollow rotor with a spur gear and a shaft with a pinion thereon, gear means driving said rotor and said shaft in the same direction, said rotor having two pistons and two reaction elements within said rotor and having a spur gear thereon, a flywheel secured to said driven shaft, a compound planetary gear set composed of a spur gear and a first elliptic gear, a second elliptic gear secured to one of said housings, said compound planetary gear set being journalled on said flywheel, a wide-faced pinion being free to turn on said shaft and mating with said compound spur gear and the spur gear on said reaction elements, whereby following the ignition of a mixture of gas and air compressed between one set of pistons and reaction elements the resulting expansive force is transmitted by the interconnected gearing to said shaft and to said flywheel.

8. A rotary internal combustion engine comprising in combination, two stationary housings to support a hollow rotor with a spur gear and a shaft with a pinion thereon, a stud secured to one of said housings, an idler gear rotatably mounted on said stud and mating with said spur gear and said pinion, said rotor driving said shaft in the same direction, said rotor having two pistons and two reaction elements within said rotor, said reaction elements having a spur gear thereon, a flywheel secured to said driven shaft, a compound planetary gear set composed of a spur gear and a first elliptic gear which mates with a second elliptic gear secured to one of said housings, said compound planetary gear set being journalled on said flywheel, a wide-faced pinion free to turn on said shaft and said pinion mating with said compound spur gear and the spur gear on said reaction elements, whereby, following the ignition of a mixture of gas and air compressed between one set of pistons and reaction elements the resulting expansive force is transmitted by the interconnected gearing to said shaft and to said flywheel, while the other set of pistons and reaction elements exhausts the burned mixture of gas and air.

* * * * *